US009387681B2

(12) United States Patent
Somano et al.

(10) Patent No.: US 9,387,681 B2
(45) Date of Patent: Jul. 12, 2016

(54) RECORDING APPARATUS AND CARRIAGE UNIT HAVING A HEAD MOUNTING MECHANISM

(75) Inventors: Toshiaki Somano, Tokyo (JP); Shiyusuke Inamura, Hino (JP); Tetsu Hamano, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/586,119

(22) Filed: Aug. 15, 2012

(65) Prior Publication Data

US 2013/0044161 A1 Feb. 21, 2013

(30) Foreign Application Priority Data

Aug. 19, 2011 (JP) ..... 2011-179609

(51) Int. Cl.
*B41J 2/175* (2006.01)
*B41J 2/15* (2006.01)

(52) U.S. Cl.
CPC *B41J 2/1752* (2013.01); *B41J 2/15* (2013.01); *B41J 2/17553* (2013.01)

(58) Field of Classification Search
CPC ..... B41J 2/1752
USPC ..... 347/37
See application file for complete search history.

(56) References Cited

U.S. PATENT DOCUMENTS

| | | | | |
|---|---|---|---|---|
| 6,250,750 | B1 * | 6/2001 | Miyazawa et al. | 347/87 |
| 6,302,535 | B1 * | 10/2001 | Sturgeon et al. | 347/86 |
| 6,481,829 | B1 * | 11/2002 | Bailey et al. | 347/49 |
| 6,623,105 | B1 * | 9/2003 | Shen | 347/49 |
| 2002/0113841 | A1 * | 8/2002 | Nishiberi | 347/50 |
| 2004/0061911 | A1 * | 4/2004 | Samoto | 358/498 |
| 2004/0183856 | A1 * | 9/2004 | Yang | 347/49 |
| 2005/0285900 | A1 * | 12/2005 | Benson et al. | 347/49 |
| 2006/0262158 | A1 * | 11/2006 | Okamura | 347/20 |
| 2007/0229582 | A1 * | 10/2007 | Yano | 347/29 |
| 2008/0038037 | A1 * | 2/2008 | DeVore et al. | 347/49 |

FOREIGN PATENT DOCUMENTS

| | | | | |
|---|---|---|---|---|
| JP | H04-133742 | A | | 5/1992 |
| JP | 2004-90343 | A | | 3/2004 |
| JP | 2004216660 | A | * | 8/2004 |
| JP | 2004-249596 | A | | 9/2004 |
| JP | 2006-305808 | A | | 11/2006 |
| JP | 2007-237677 | A | | 9/2007 |

* cited by examiner

*Primary Examiner* — Shelby Fidler
(74) *Attorney, Agent, or Firm* — Canon USA, Inc. IP Division

(57) ABSTRACT

A movable carriage unit on which a head for discharging ink is mountable includes a fixing member movable between a fixing position for fixing the head to a mounting position and a releasing position for releasing the fixation of the head, and a moving unit including an operation portion. The moving unit is configured to move the fixing member from the fixing position to the releasing position. A guide configured to guide the head to the mounting position when the fixing member is moved to the releasing position by an operation of the operation portion is formed on the operation portion.

14 Claims, 15 Drawing Sheets

RECORDING APPARATUS AND CARRIAGE UNIT HAVING A HEAD MOUNTING MECHANISM

BACKGROUND OF THE INVENTION

1. Field of the Invention

The present disclosure relates to a recording apparatus. More particularly, the present disclosure relates to a recording apparatus for performing recording by discharging ink from a recording head detachably attached on a carriage capable of moving on a recording medium.

2. Description of the Related Art

Recording methods used in a recording apparatus include an inkjet recording method. The inkjet recording method enables the recording apparatus to be relatively small and inexpensive, and enable high-definition recording. The recording apparatus (inkjet recording apparatus) employing the inkjet recording method typically includes a recording head having ink discharge ports. The recording head can be an inkjet recording head or an inkjet head having integrated recording head with ink retaining unit. The recording head (inkjet head) is detachably attached on a carriage. The carriage on which the inkjet head is mounted is moved to perform recording. The head can be replaced with a new head when the ink in the inkjet head is used up or the inkjet head is broken. The replacement enables the inkjet recording apparatus to readily return to a recordable state.

When the head is mounted on the carriage, the head is to be pressed against the carriage to fix (position) the head to the carriage and to electrically couple the head and the recording apparatus body. In many cases, the head has a substrate (head substrate) or a flexible substrate (flexible printed circuit (FPC)) having a conductor exposed portion on which resist processing is not performed. The carriage on which the head is mounted has an insulation displacement connector for electrically coupling with the conductor exposed portion of the head. The insulation displacement connector is a plated metal member. Using elastic deformation of metal, the insulation displacement connector can be pressed onto the conductor exposed portion of the head and can be electrically coupled with the conductor exposed portion of the head. The insulation displacement connector is soldered to a substrate (carriage substrate) mounted on the carriage. The carriage substrate is electrically coupled with a circuit board (control circuit) at the recording apparatus body side via a flexible flat cable (FFC) or an FPC board.

As examples of head mounting methods, Japanese Patent Application Laid-Open No. 2004-90343 discusses a method of inserting a head from the upper portion of a carriage to mount the head, and Japanese Patent Application Laid-Open No. 2006-305808 discusses a method of inserting a head from the front of a carriage to mount the head.

In the method of mounting a head from the upper portion of a carriage, the head placed on the carriage is fixed by a fixing unit rotatably provided on the carriage. The fixing member includes an operation portion. When a user fixes the head to the carriage, the user turns the fixing member together with the operation portion at a replacement position set in a moving range of a recording unit, and the carriage becomes a head attachable/detachable state. In the state, the user inserts the head into the carriage, and turns the fixing member to press the head against the carriage. By the operation, the head can be fixed on the carriage.

In the method of mounting the head from the front of the carriage, a guide member (supporting base) is provided to prevent the head from falling off the carriage and to guide the head to the carriage. The head is guided by the supporting base from the front of the carriage to the carriage, and a pressure reception portion of the head moves beyond an inclined plane of a head set cam pressed by a spring. Thus, the head receives pressing force and the head is fixed to the carriage.

In the configuration of inserting the head from the upper portion of the carriage, with a cover or a scanner at the upper portion of the recording apparatus body opened, a space enough to pass the head and a space enough to turn the operation portion of the fixing member are to be provided, and this limits the apparatus design. When the cover or the scanner at the upper portion of the recording apparatus body is configured such that the cover or the scanner cannot be opened, the head is to be inserted deep into the recording apparatus to attach or detach the head, and this causes operational problems. In order to increase the operability of the user, a wide opening portion of the recording apparatus body to access the carriage is to be provided. This, however, increases the whole size of the apparatus.

On the other hand, in the configuration of inserting the head from the front of the carriage, the user is not required to hold up the body cover or the scanner. Thus, it is not necessary to provide the space above the apparatus (carriage). Further, in fixing the head, the user only has to push the head against the carriage, and the operability can be increased. However, the above-described supporting base is to be provided outside the operating range of the carriage in order to prevent the head insertion operation from interfering with a spur unit of the recording portion heightwise. This increases the costs and the width of the apparatus body.

SUMMARY OF THE INVENTION

The present disclosure is directed to a recording apparatus provided with an inexpensive and simple head mounting mechanism without increasing the size and cost.

According to an aspect of the present disclosure, a movable carriage unit on which a head for discharging ink is mountable includes a fixing member movable between a fixing position for fixing the head to a mounting position and a releasing position for releasing the fixation of the head, and a moving unit including an operation portion. The moving unit is configured to move the fixing member from the fixing position to the releasing position. A guide configured to guide the head to the mounting position when the fixing member is moved to the releasing position by an operation of the operation portion is formed on the operation portion.

According to exemplary embodiments, a recording apparatus having an inexpensive and simple head mounting mechanism can be provided without increasing the size and costs.

Further features and aspects of the present disclosure will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the disclosure and, together with the description, serve to explain the principles disclosed herein.

DESCRIPTION OF THE EMBODIMENTS

Various exemplary embodiments, features, and aspects of the disclosure will be described in detail below with reference to the drawings.

Figure 1:
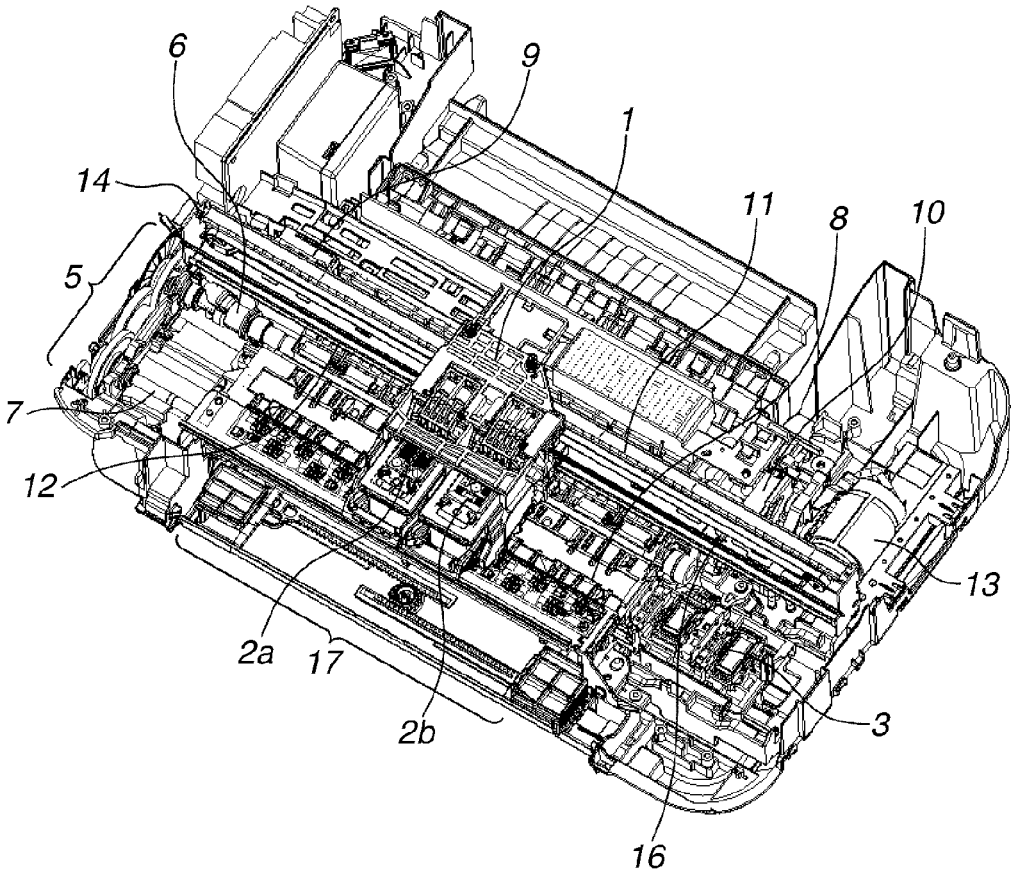
FIG. 1 is a perspective view illustrating an inkjet printer that serves as a recording apparatus according to an exemplary embodiment.

FIG. 1 is a perspective view illustrating an inkjet printer that serves as a recording apparatus according to an exemplary embodiment disclosed herein.

The inkjet printer according to the exemplary embodiment illustrated in FIG. 1 includes a sheet feed unit (not illustrated), a sheet conveyance unit (paper conveyance unit) 5, a recording unit 17, and a maintenance unit 3 that recovers a recording head in the recording unit 17. The recording operation starts after recording data transmitted from a host apparatus (not illustrated) is stored in a recording apparatus control unit (not illustrated) on a control substrate and a recording operation start instruction is issued from the control unit. The maintenance unit 3 has a function to recover conditions in ink discharge ports to a normal condition by capping the ink discharge port portions of heads (recording heads) 2*a* and 2*b*, which will be described below, and suctioning ink from the ink discharge ports.

In the recording operation, first, a sheet feeding operation is performed. In response to the sheet feeding operation, a line feed motor ((LF motor) (conveyance motor) (not illustrated)) rotates and feeding rollers (not illustrated) provided in the sheet feed unit rotate via a gear array. A plurality of sheets (not illustrated) are conveyed to a separation unit (not illustrated) by the feeding rollers. The sheets carried are separated and drawn one by one by the separation unit and conveyed to a sheet conveyance unit 5. The sheet conveyed to the sheet conveyance unit 5 is nipped by a conveyance roller 6 and a pinch roller (not illustrated) being pressed against the conveyance roller 6 by spring force. After the nipping, the driving force of the feeding rollers (not illustrated) is cut off, and the feeding rollers rotate together with the sheet. The rotation of the conveyance roller 6 driven by the LF motor (conveyance motor) (not illustrated) via the gear array conveys the nipped sheet to a recording unit 17. The sheet is conveyed to the side of a discharge roller 7 every predetermined amount of line feeds. The sheet is conveyed only by the conveyance roller 6 and the pinch roller (not illustrated) until the leading edge of the recording medium reaches a first spur array 8 and nipped by the discharge roller 7 and the first spur array 8. The peripheral speeds of the conveyance roller 6 and the discharge roller 7 are set to substantially the same speeds, and the two rollers 6 and 7 are connected via the gear array to rotate in synchronization with each other. Thus, although the sheet is nipped by the discharge roller 7 and the first spur array 8, the sheet is not pulled or loosen. After the trailing edge of the sheet passed through the conveyance roller 6, the sheet is conveyed only by the discharge roller 7 until the printing ends and the sheet is discharged.

The recording unit 17 includes heads 2*a* and 2*b* and a carriage unit 1. The heads 2*a* and 2*b* mainly serve as recording heads and are detachably attached to mounting positions on the carriage unit 1. The carriage unit 1 reciprocates in the directions intersecting with the sheet conveyance direction. The heads 2*a* and 2*b* include the color head 2*a* and the black head 2*b*. The carriage unit 1 is guided and supported by a chassis 11 being fixed to a left plate 9 and a right plate 10, and a guide rail 12 being fixed to the chassis 11. The carriage unit 1 reciprocates by the driving force of a carriage motor 13, the driving force is transmitted via a carriage belt 15 stretched between the carriage motor 13 and an idler pulley 14. An encoder sensor (not illustrated in FIG. 1) provided in the carriage unit 1 reads a code strip 16 stretched on the chassis 11, and ink droplets can be discharged toward the sheet at an appropriate timing. In response to the completion of the recording of one line by the above-described operation, the sheet conveyance unit 5 conveys the sheet by a necessary amount, and the recording operation of one line is performed again. By repeating the operation, the recording can be performed onto the whole recording sheet.

The heads 2*a* and 2*b* and the recording apparatus body are electrically coupled by conductor exposed portions (described below) and a head connector (not illustrated in FIG. 1) of the carriage unit 1. The conductor exposed portions are provided on FPCs (not illustrated) of the heads 2*a* and 2*b* and resist processing is not performed thereon. The head connector is soldered to a carriage substrate (not illustrated) provided on the carriage unit 1. The carriage substrate is electrically coupled with a circuit board (control circuit) at the recording apparatus body side via an FFC (not illustrated). A signal from a head driver is transmitted to the heads 2*a* and 2*b* via the FFC, and ink droplets can be discharged according to the recording data.

The components constituting the inkjet printer according to the exemplary embodiment are described.

The structure of the carriage unit 1 is described with reference to FIGS. 2 to 4.

Figure 2:
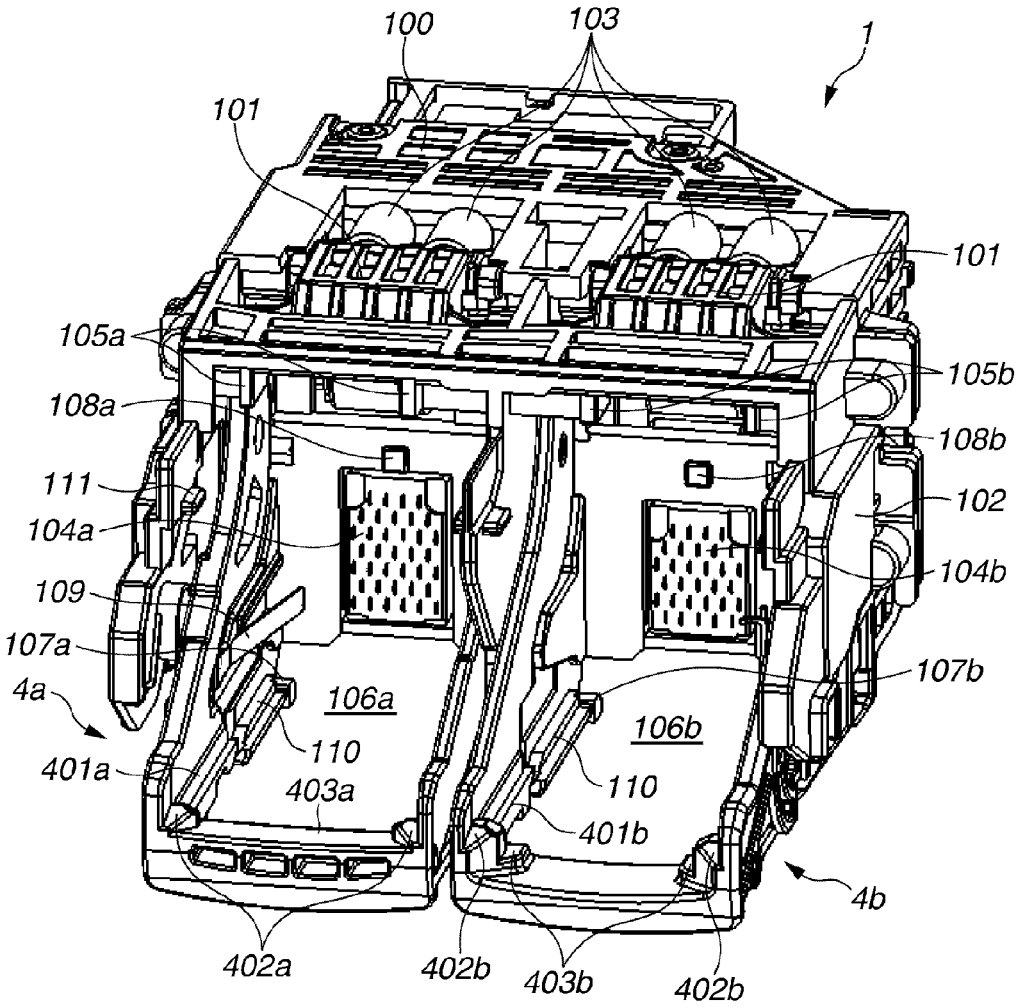
FIG. 2 is a perspective view illustrating a carriage unit according to the exemplary embodiment.
Figure 3:
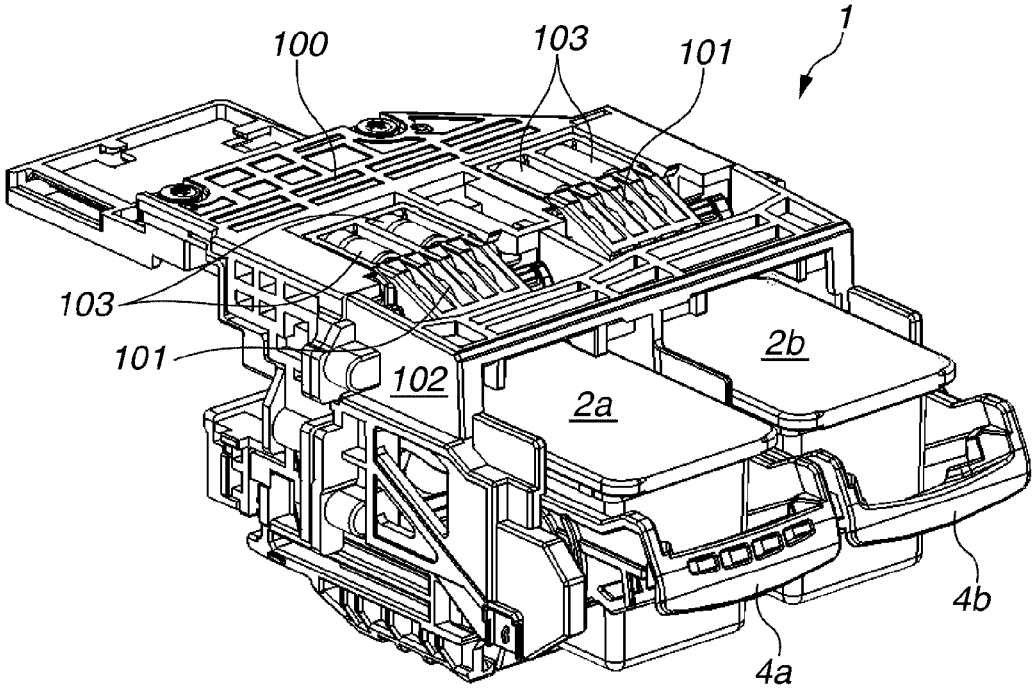
FIG. 3 is a perspective view illustrating the carriage unit illustrated in FIG. 2, on which heads are mounted.

FIG. 2 is a perspective view illustrating the carriage unit 1, viewed from the side where spaces for housing the heads are formed. FIG. 3 and FIG. 4 are a perspective view and a cross-sectional view illustrating the carriage unit 1 in a state the heads (the color head 2*a* and the black head 2*b*) are attached.

The carriage unit 1 includes a carriage 100 and a front cover 102 fixed to the carriage 100. The carriage unit 1 further includes head set levers 4*a* and 4*b* rotatably (movably) provided to the front cover 102 and an FFC (not illustrated).

The carriage 100 includes an encoder sensor (not illustrated) and a carriage substrate 104 on which head connectors 104*a* and 104*b* are soldered. As described above, the carriage substrate 104 is electrically coupled with the circuit board (control circuit) (not illustrated) at the apparatus body side via the FFC. As illustrated in FIG. 2, the carriage 100 further includes head protruding portion reception portions 108*a* and 108*b*, head positioning groove reception portions 107*a* and 107*b*, and head guide portions 110 for guiding the heads 2*a* and 2*b*. The carriage 100 further includes head set lateral springs 109 that serve as leaf springs.

The front cover 102 includes head reception bosses 111, and head erroneous attachment prevention ribs 105*a* and 105*b*.

The head set levers 4*a* and 4*b* include guide portions 401*a* and 401*b* for guiding the heads 2*a* and 2*b*, head support portions 402*a* and 402*b* and head support surfaces 403*a* and 403*b* for supporting the heads 2*a* and 2*b*. The headset levers 4*a* and 4*b* are rotatably supported by a shaft 4*c* with respect to the carriage 100. The positions of the head set levers 4*a* and 4*b* can be shifted between a held-down first position illustrated in FIG. 2 and a held-up second position illustrated in FIGS. 2 and 3. When a user turns the head set levers 4*a* and 4*b*, the user grabs the portions where the head support surfaces 403*a* and 403*b* are formed as operation portions. When the head set levers 4*a* and 4*b* are at the first positions, housing portions 106*a* and 106*b* that are spaces for housing the heads 2*a* and 2*b* are formed as illustrated in FIG. 2. When the head set levers 4*a* and 4*b* are at the second positions, the heads 2*a* and 2*b* are fixed to the carriage unit 1 as illustrated in FIGS. 3 and 4.

The carriage unit 1 further includes head set cams 101 and head set cam springs 103. The head set cam springs 103 include compressed springs, and the springs 103 press (urge) the head set cams 101 with the carriage 100 acting as fulcrums. The head set cams 101 are urged by the head set cam springs 103 to press and contact the heads 2*a* and 2*b* (head pressure reception portions, described below) illustrated in FIG. 4, and pull the heads 2*a* and 2*b* in the direction A. By the structure, the heads 2*a* and 2*b* can be pressed against the head connectors 104*a* and 104*b*, and can be fixed to the carriage unit 1. In other words, the head set cams 101 function as fixing units or fixing members for fixing the heads 2*a* and 2*b* to the carriage unit 1.

Figure 5A:
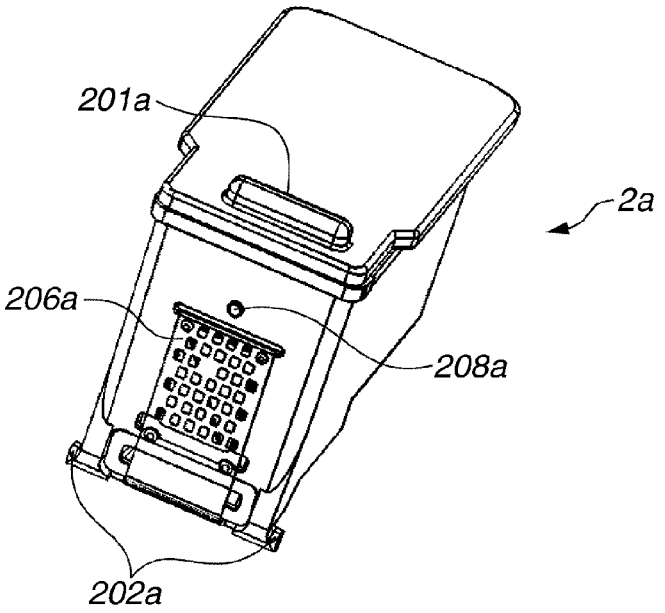
FIGS. 5A and 5B are perspective views illustrating the head to be mounted on the carriage unit illustrated in FIG. 2.
Figure 5B:
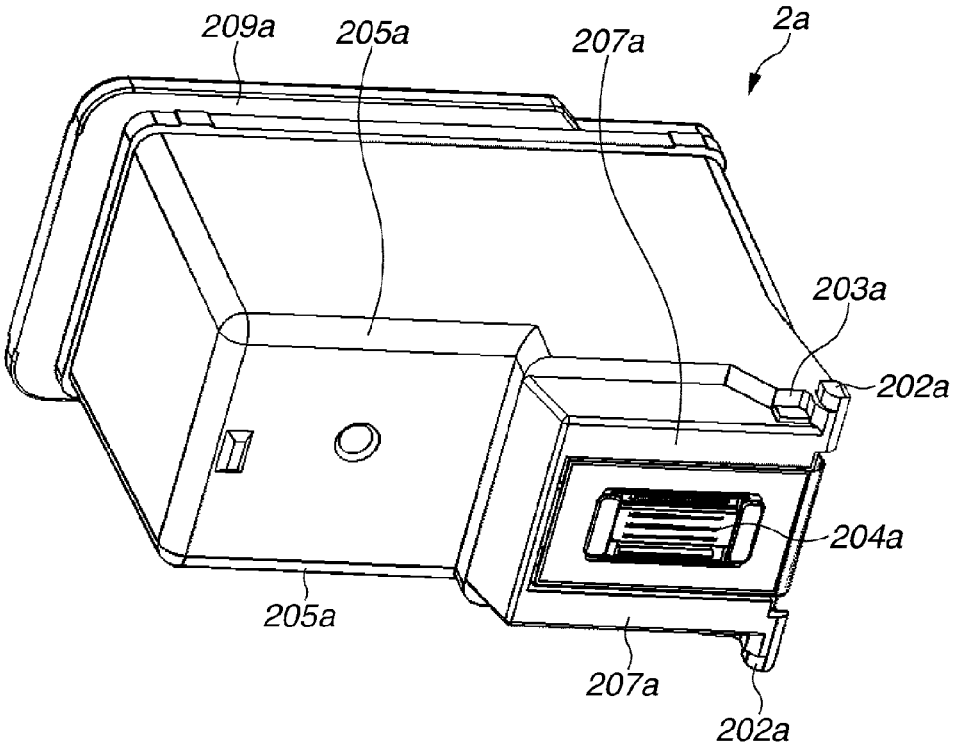

FIGS. 5A and 5B are perspective views illustrating the heads according to the exemplary embodiment. The color head 2*a* and the black head 2*b* have similar structures except for the head pressure reception portions described below. Accordingly, in the description below, as long as not specifically mentioned, only the color head 2*a* is illustrated in the drawings, and the head structure is described with reference to the color head 2*a*.

As illustrated in FIGS. 5A and 5B, the head 2*a* includes an ink discharge port 204*a* for discharging ink and a conductor exposed portion 206*a* to be electrically connected to the carriage 100. The surface on which the conductor exposed portion 206*a* is provided is called the head front surface, and the opposite surface is called the head rear surface. The surface on which the ink discharge port 204*a* is provided is called the head lower surface, and the opposite surface is called the head upper surface.

Figure 4:
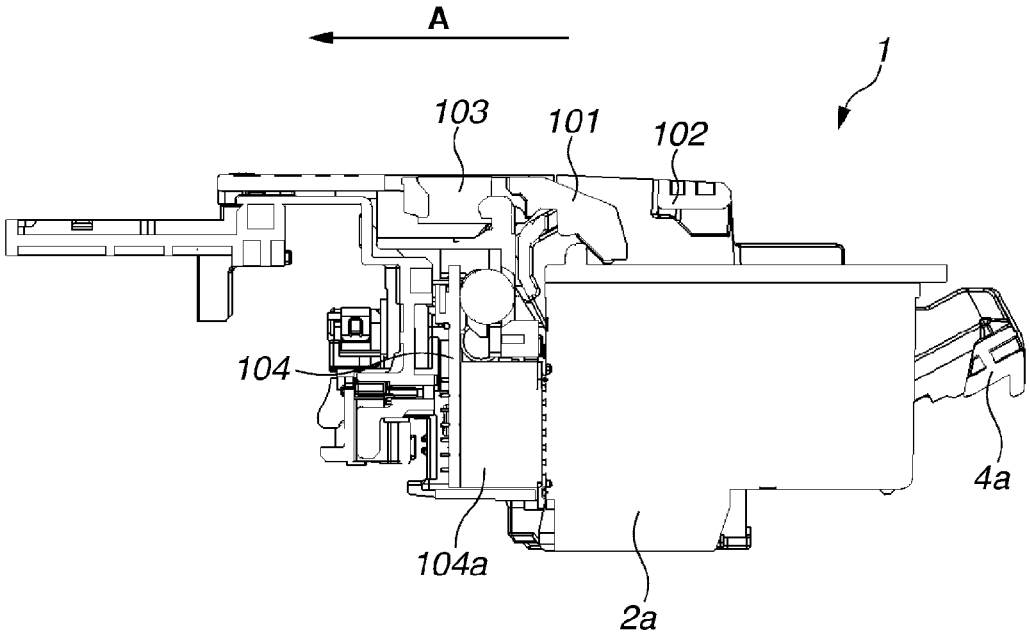
FIG. 4 is a cross-sectional view illustrating the carriage unit illustrated in FIG. 2, on which the heads are mounted.

The head 2*a* includes a head pressure reception portion 201*a* formed on the head upper surface and contacts the head set cam 101 when the head 2*a* is positioned at the mounting position as illustrated in FIG. 4. The head 2*a* further includes a head protruding portion 208*a* formed on the head front surface, a pair of rough guide portions 202*a* protruding toward the head side near the boundary of the head front surface and the head lower surface, and head positioning grooves 203*a* formed on the head rear surface side of the rough guide portions 202*a*. The head 2*a* further includes tab both side surfaces 207*a* formed at the both sides of the ink discharge port 204*a* on the head lower surface, and head set lever reception portions 205*a* formed at the head rear surface side of the ink discharge port 204*a*. When the head 2*a* is attached to the carriage unit 1, the rough guide portions 202*a*, the tab both side surfaces 207*a*, and the head set lever reception portions 205*a* contact the head set lever 4*a* and the carriage 100, and support the head 2*a*. When the head 2*a* is attached to the carriage unit 1, the head protruding portion 208*a* and the head positioning grooves 203*a* position the head 2*a*. At the head upper surface side, a boss reception portion 209*a* that contacts the head reception boss 111 of the front cover 102 is formed.

Figure 6:
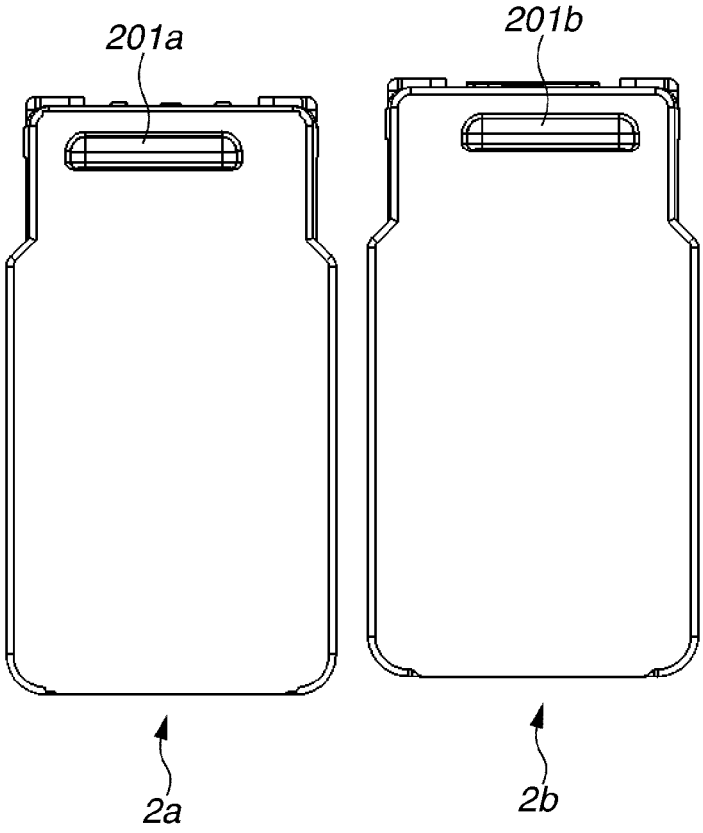
FIG. 6 is a plan view of the heads illustrated in FIGS. 5A and 5B viewed from above.

FIG. 6 is a plan view illustrating the head according to the exemplary embodiment viewed from the upper side. In FIG. 6, the head pressure reception portions 201*a* and 201*b* are provided in different positions in the color head 2*a* and the black head 2*b* respectively. The head pressure reception portions 201*a* and 201*b* are formed such that when the user tries to attach the heads 2*a* and 2*b* to housing portions different from the corresponding housing portions, the head pressure reception portions 201*a* and 201*b* interfere with the above-described head erroneous attachment prevention ribs 105*a* and 105*b* provided on the front cover 102. The structure prevents the erroneous attachment of the heads 2*a* and 2*b* to the housing portions different from the corresponding housing portions respectively.

With reference to FIGS. 2, 4, 5A, and 5B, a method of fixing the heads to the carriage unit is described.

The head set cam 101 on the carriage unit 1 is urged by the head set cam spring 103 to press and contact the pressure reception portion 201*a* of the head 2*a*. The head pressure reception portion 201*a* is pressed by the head set cam 101, and receives a force to pull the head 2*a* in the direction A as illustrated in FIG. 4. By the pressing force, the head 2*a* is fixed to the carriage 100 and is electrically coupled with the head connector 104*a*. The head protruding portion 208*a* of the pressed head 2*a* contacts the head protruding portion reception portion 108 of the carriage 100, and the head positioning groove 203*a* contacts the positioning groove reception portion 107*a* of the carriage 100. By the structure, the movement of the head 2*a* in the vertical and front-back directions is regulated against the carriage 100. The head 2*a* is positioned by the pressure of the carriage 100 in the horizontal direction, applied by the head set lateral spring 109 attached to the carriage 100. The head 2*a* and the head connector 104*a* are electrically coupled when metal pins of the head connector 104*a* contact the conductor exposed portion 206*a* of the head 2*a*.

Figure 7:
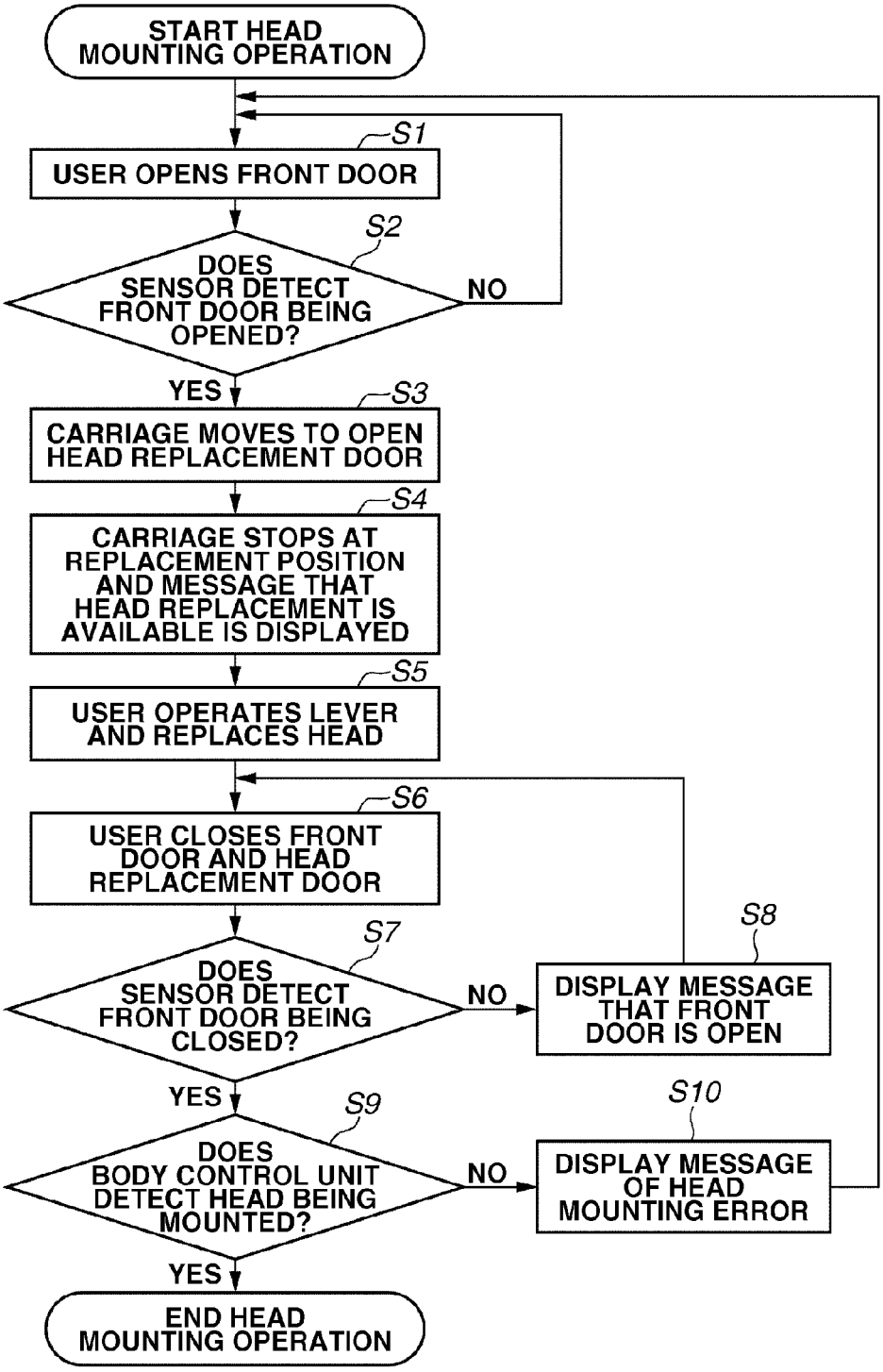
FIG. 7 is a flowchart illustrating a head mounting operation according to the exemplary embodiment.

With reference to FIG. 7, a head mounting operation by a user according to the exemplary embodiment is described. FIG. 7 is a flowchart illustrating the head mounting operation according to the exemplary embodiment.

In step S1, the user opens a front door (not illustrated). In step S2, a door sensor (not illustrated) detects the open-close state of the front door. If the front door is closed (NO in step S2), the carriage unit operation does not proceed to the head replacement. If the door sensor detects that the front door is open (YES in step S2), a message indicating that the front door is open is displayed on a display board for the user. In step S3, a head replacement door for replacing the head is opened by carriage movement. In step S4, the carriage stops at a replacement position, and a message indicating that the head replacement is available is displayed on the display board. In step S5, the user operates the head set lever to fix the head to the carriage as described below. In step S6, the user closes the front door and the head replacement door. In step S7, the door sensor determines whether the front door is properly closed. If the front door is open (NO in step S7), then in step S8, a message indicating that the front door is open is displayed on the display board, and the processing does not proceed to the following operation. If the sensor determines that the front door is closed (YES in step S7), then in step S9, whether the head is mounted is determined. If the head and the recording apparatus body are electrically coupled (YES in step S9), the head mounting operation ends. If the head and the recording apparatus body are not electrically coupled (NO in step S9), then in step S10, a head mounting error message is displayed. In such a case, the head mounting operation is performed again.

Figure 8:
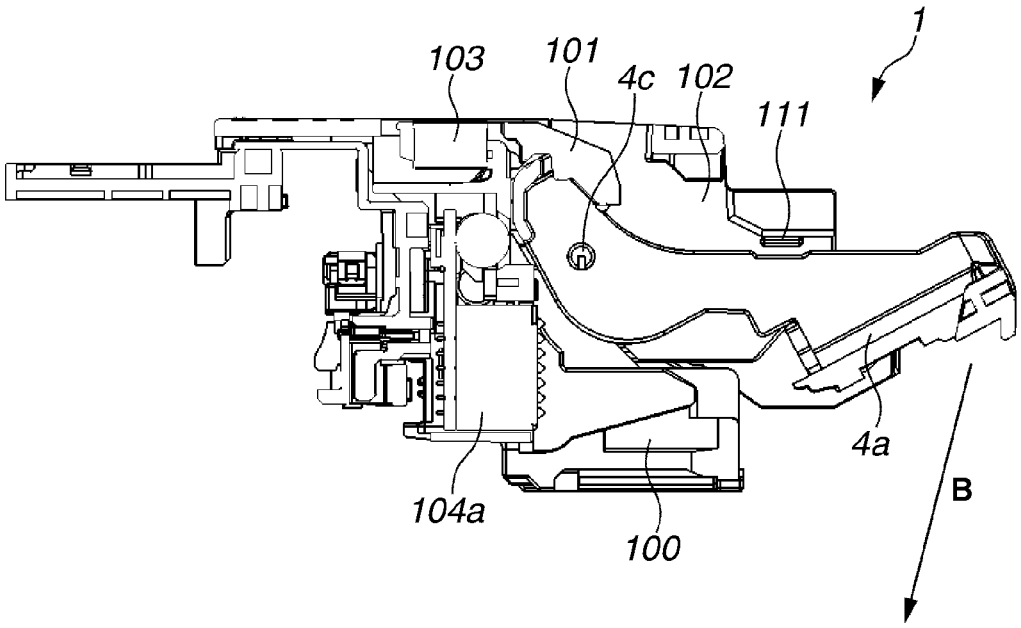
FIG. 8 is a cross-sectional view illustrating the carriage unit with a head set lever held up.
Figure 9:
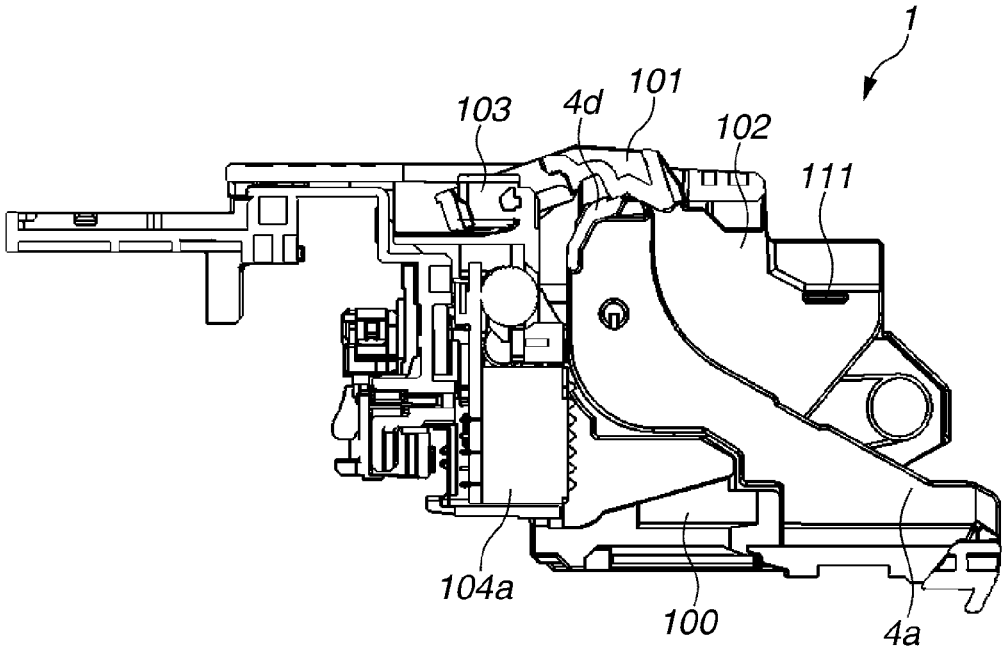
FIG. 9 is a cross-sectional view illustrating the carriage unit with the head set lever held down.

With reference to FIGS. 8 to 14, a method of inserting the head into the carriage unit according to the exemplary embodiment is described in detail. FIGS. 8 and 9 are cross-sectional views illustrating the carriage unit according to the exemplary embodiment. FIGS. 10 to 14 are cross-sectional views or enlarged cross-sectional views of the carriage unit illustrating the insertion operation of the head according to the exemplary embodiment.

First, the carriage unit 1 is assumed to be positioned at the second position illustrated in FIG. 8. At the position, the head set cam 101 is urged by the head set cam spring 103, and the cam 101 is positioned at a position (fixing position) where the cam 101 can press the head 2*a* to fix to the carriage unit 1 as illustrated in FIG. 4.

The head set lever 4*a* is turned in the arrow B direction as illustrated in FIG. 8 to the first position illustrated in FIG. 9 such that the housing portion can receive the head 2*a*. In the operation, the head set cam 101 contacts a cam portion 4*d* formed on the head set lever 4*a*, and the head set cam 101 is held up upward by the cam portion 4*d*. By the operation, the head set cam 101 is not positioned at the fixing position illustrated in FIG. 8 anymore, and positioned at a position (releasing position) for releasing the fixation of the head 2*a*.

Figure 10:
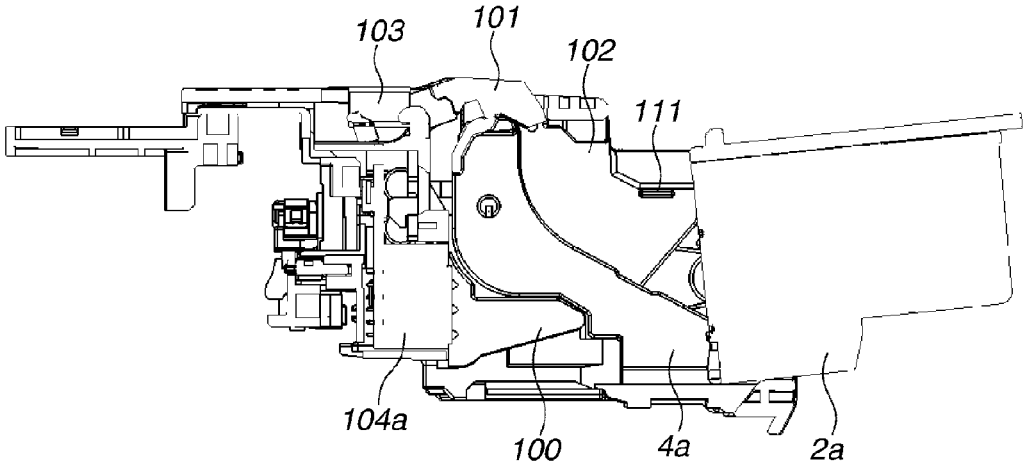
FIG. 10 is a cross-sectional view of the carriage unit illustrating a head insertion operation.
Figure 11:
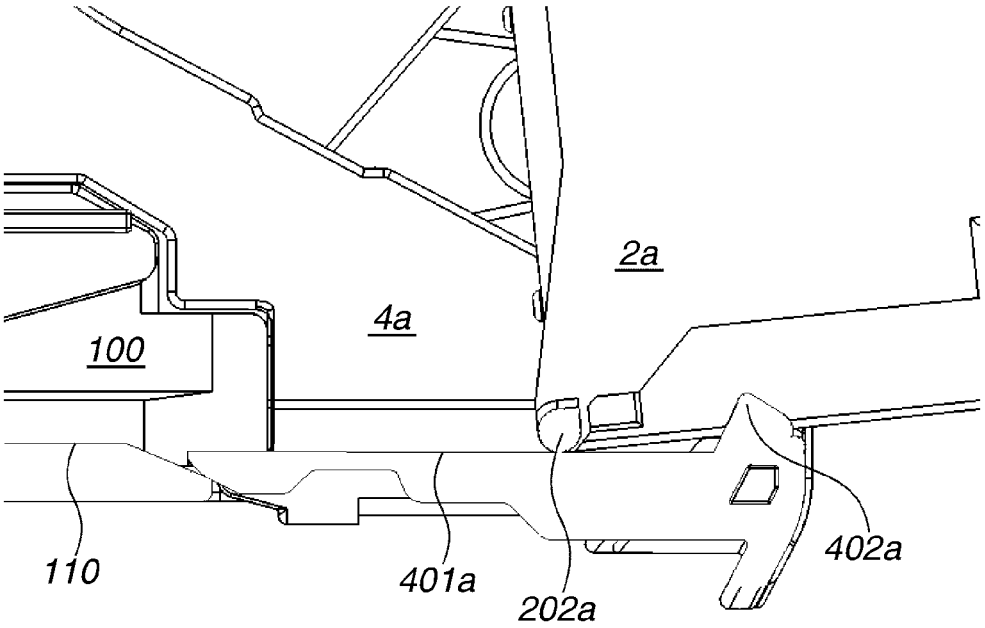
FIG. 11 is an enlarged cross-sectional view of the carriage unit illustrating the head insertion operation.

From the position, as illustrated in FIG. 10, the user inserts the head 2*a* into the carriage unit 1 while setting the head front surface in the direction toward the carriage 100. In the operation, as illustrated in FIG. 11, the user inserts the head 2*a* into the carriage unit 1 such that the two rough guide portions 202*a* move beyond the head support portion 402*a* of the headset lever 4*a* to keep the state contacting the guide portion 401*a*. Alternatively, the user inserts the head 2*a* into the carriage unit 1 while keeping the state that the tab both side surface 207*a* of the head 2*a* contacts the head support surface 403*a* (illustrated in FIG. 2) of the head set lever 4*a*, or keeping both of these two contact states. The user further presses the head 2*a* until the tab both side surface 207*a* of the head passes through the head support surface 403*a* of the head set lever 4*a*. In the operation, since the head support surface 403*a* of the head set lever 4*a* is curved to protrude downward, the ink discharge port 204*a* of the head 2*a* does not contact the head set lever 4*a*.

Figure 12:
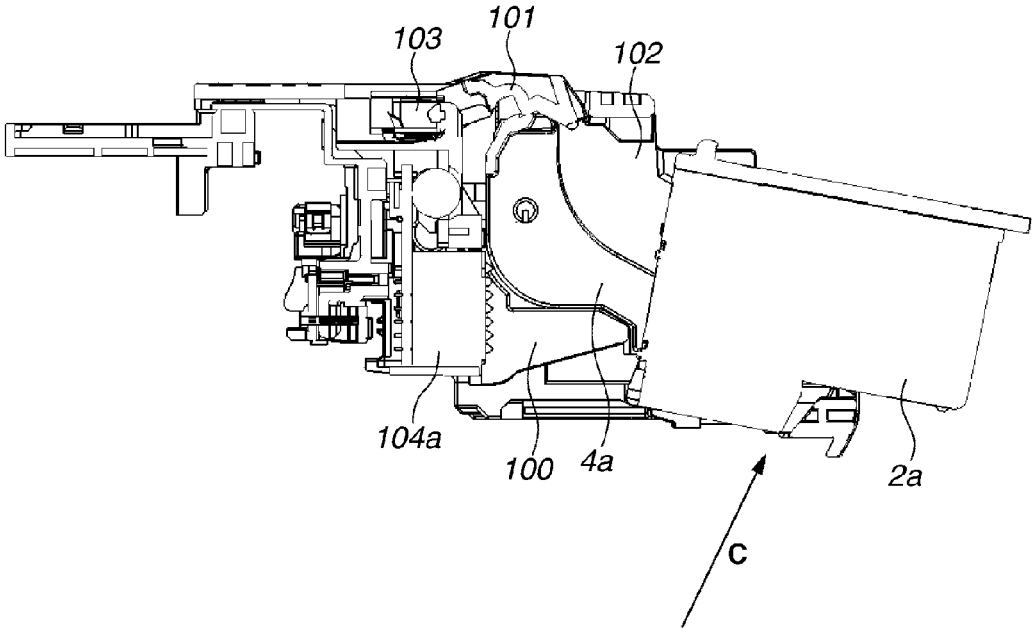
FIG. 12 is a cross-sectional view of the carriage unit illustrating the head insertion operation.
Figure 13:
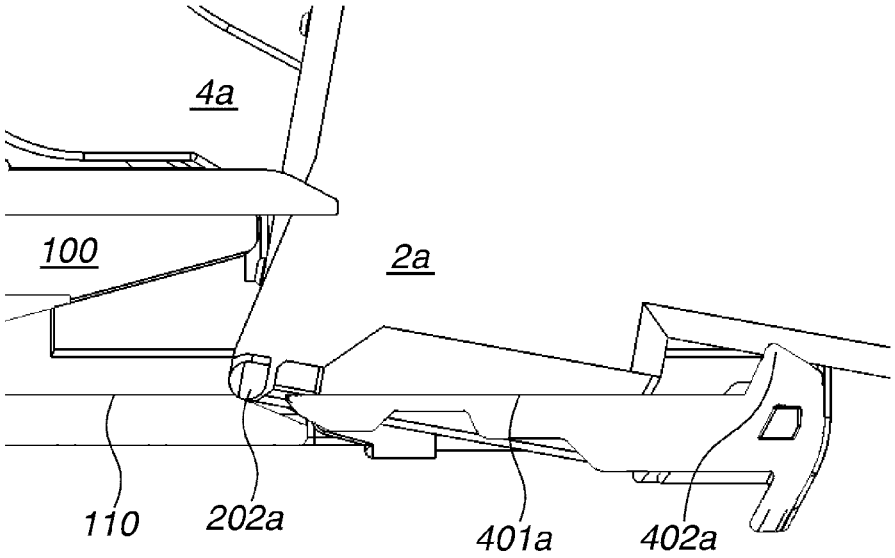
FIG. 13 is an enlarged cross-sectional view of the carriage unit illustrating the head insertion operation.

The user keeps pressing the head 2*a* into the carriage unit 1, and as illustrated in FIGS. 12 and 13, the tab both side surface 207*a* of the head 2*a* passes through the head support surface 403*a* of the head set lever 4*a*. In this state, the rough guide portion 202*a* of the head 2*a* is supported by the head guide portion 110 of the carriage 100 or the guide portion 401*a* of the head set lever 4*a*. The head set lever reception portion 205*a* of the head 2*a* is supported by the head support portion 402*a* of the head set lever 4*a*. These structures prevent the head 2*a* from falling off the carriage unit 1 and thus, the user is not required to hold the head 2*a*. At the position, even if the user turns and moves the headset lever 4*a* in the direction C as illustrated in FIG. 12, the head 2*a* does not move to the position where the head set cam 101 contacts the pressure reception portion 201*a* of the head 2*a*. In other words, the head 2*a* is held up by the headset lever 4*a*, but the head 2*a* contacts the head erroneous attachment prevention rib 105*a* of the front cover 102, and consequently, the head 2*a* cannot move further. Thus, the head 2*a* does not press the head connector 104*a*.

Figure 14:
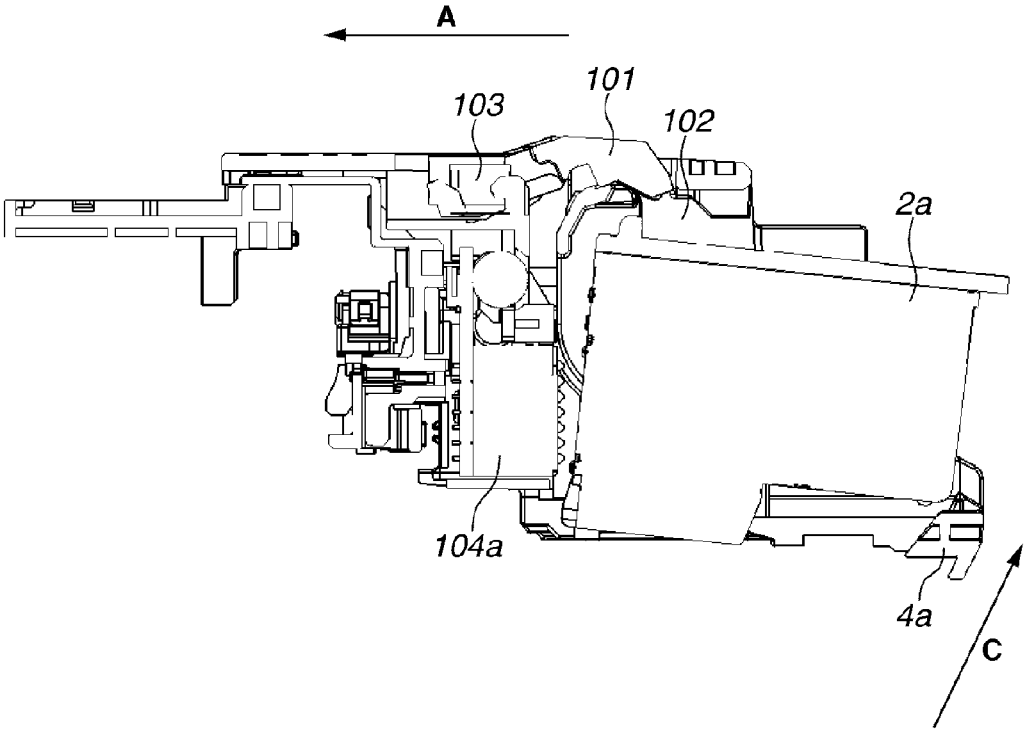
FIG. 14 is a cross-sectional view of the carriage unit illustrating the head insertion operation.

Following the operation, as illustrated in FIG. 14, when the headset lever reception portion 205*a* at the head rear surface side passes through the head support portion 402*a* of the head set lever 4*a*, the head set lever 4*a* can be held up and the head 2*a* can be set to the carriage unit 1. In the state, the rough guide portions 202*a* of the head 2*a* are positioned on the inclined planes of the head positioning groove reception portions 107*a* of the carriage 100, and the boss reception portions 209*a* of the head 2*a* are supported by the head reception bosses 111 of the front cover 102. In other words, the head 2*a*, being at this position, is also supported at the two points of the rough guide portions 202*a* and the two points of the boss reception portions 209*a*. Thus, the head 2*a* is prevented from falling off the carriage unit 1.

At the position illustrated in FIG. 14, the head 2*a* does not contact the head set lever 4*a*, and the head 2*a* does not affect the rotation operation of the headset lever 4*a*. As a result, the user can turn and move the head set lever 4*a* in the direction C. When the user turns and moves the head set lever 4*a* in the direction C, the state that the head set cam 101 contacts the head set lever 4*a* is released, and the head set cam 101 is urged by the head set cam spring 103 that serves as an urging unit from the releasing position (as illustrated in FIG. 9) to the fixing position (as illustrated in FIG. 8). The head set cam 101 contacts the pressure reception portion 201*a* of the head 2*a*, and the head set cam 101 presses and moves the head 2*a* in the direction A by the urging force of the head set cam spring 103. By the pressing force, the head 2*a* is fixed to the carriage unit 1 (as illustrated in FIG. 4), and the conductor exposed portion 206*a* of the head 2*a* contacts the metal pins of the head connector 104*a* to be electrically connected with each other.

As described above, according to the exemplary embodiment, the heads can be attached to the carriage unit from the front of the carriage. Thus, it is not necessary to provide sufficient space above the carriage unit, and is not necessary to perform the operation of holding up the cover of the recording apparatus body. In the exemplary embodiment, the head set lever of the carriage unit serves as the switching unit for switching the positions of the head set cam that serves as the fixing unit of the head, and the head set lever also serves as the guide portion for guiding the head to the mounting position in the head carriage unit. In other words, the head set lever that serves as the switching unit of the head set cam (fixing unit) forms the guiding path for guiding the head to the mounting position when the head set lever positions the head set cam to the releasing position. Consequently, it is not necessary to provide a member for supporting the head and guiding to the carriage unit as a separately provided member of the carriage unit. This can achieve the head mounting mechanism without increasing the size and costs of the recording apparatus.

In the exemplary embodiment, when the head is positioned at the mounting position in the carriage unit, the head set cam can be moved from the releasing position to the fixing position by switching the head set lever from the first position to the second position. In other words, the head can be fixed to the carriage unit by just moving the head set lever, thus improving the operability of the user in the head replacement operation. The exemplary embodiment is advantageous at the point that the head set lever does not interfere with the spur unit when the head set lever fixes the head (positioned at the second position) and the carriage unit is moved.

Figure 15:
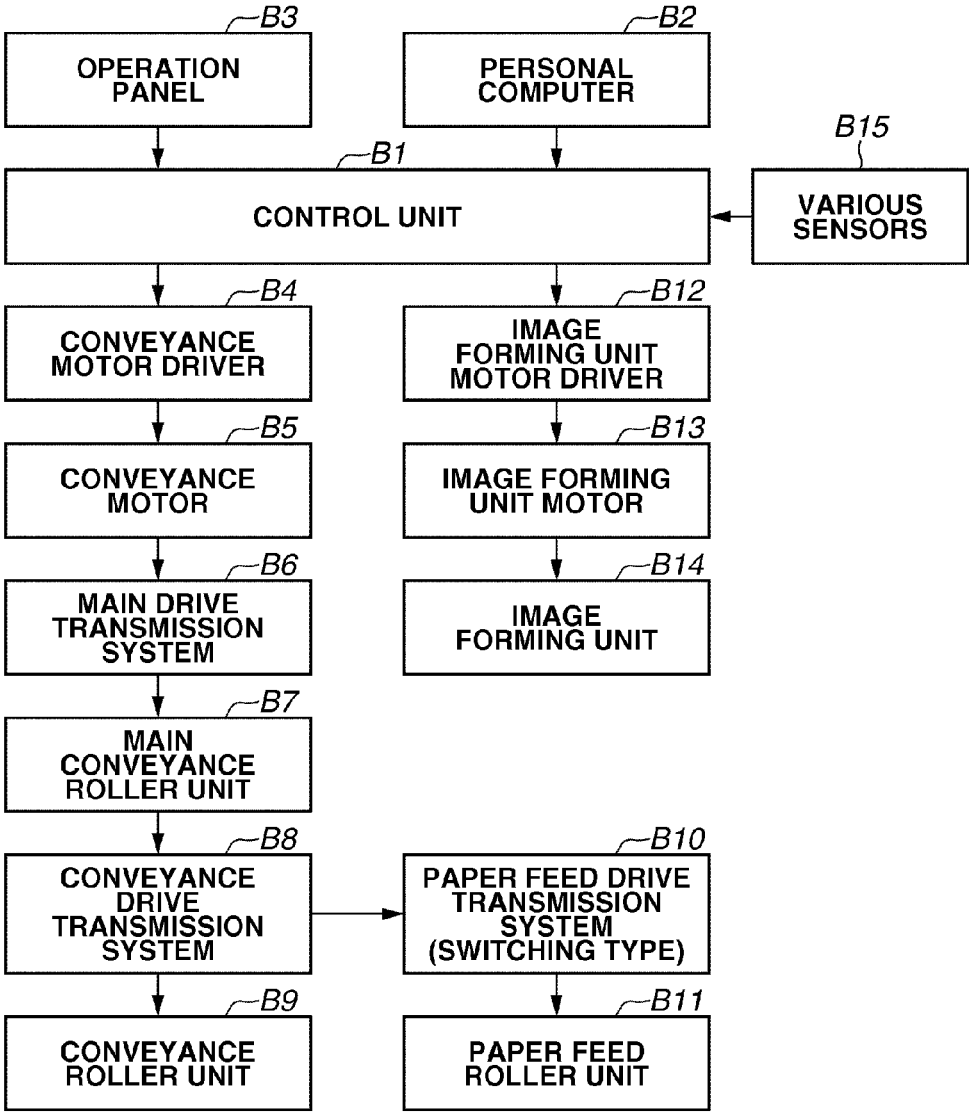
FIG. 15 is a schematic block diagram illustrating an image forming operation performed in the recording apparatus according to the exemplary embodiment.

FIG. 15 is a block diagram illustrating a schematic configuration of the recording apparatus according to the exemplary embodiment.

A personal computer B2 for transmitting a signal to the control unit B1 is connected to an interface portion of a control unit B1 for processing various types of signals. The recording apparatus body includes an operation panel B3 for directly transmitting a signal to the control unit B1. The control unit B1 starts an image forming operation in response to reception of an image forming instruction from the personal computer B2 or the operation panel B3. Alternatively, the image forming operation is started by a timer in the control unit B1. At this time, the control unit B1 issues an instruction for supplying electric power to a conveyance motor B5 via a motor driver B4 and simultaneously, issues an instruction for supplying electric power to an image forming unit motor B13 via an image forming motor driver B12. The conveyance motor B5 is connected to a main drive transmission system B6. The conveyance motor B5 drives a main conveyance roller unit B7 for conveying a recording medium in the image forming operation via the main drive transmission system B6. The main conveyance roller unit B7 is connected to a conveyance drive transmission system B8. The main conveyance roller unit B7 drives a conveyance roller unit B9 for conveying the supplied recording medium to the position of the main conveyance roller via the conveyance drive transmission system B8.

An image forming motor B13 is connected to an image forming unit B14, and by the drive, the image forming operation is performed. The image forming unit B14 cooperates with the operation of the conveyance drive transmission system B8, and performs an operation of a sheet feed drive transmission system B10 for operating a sheet feed roller unit B11 for separating carried recording media one by one and feeding the sheet. Depending on the operation of the sheet feed drive transmission system B10, power transmission and non-transmission to the sheet feed roller unit B11 is switched, and depending on various types of timings, the transmission and the non-transmission are selectively switched. As a result, synchronous drive or asynchronous drive of the sheet feed roller unit B11 and the conveyance roller unit B9 can be performed.

The rotation condition and the load condition of the individual motors and the conveyance condition of the recording sheet are detected by the various sensors B15 provided at the various points of the printer, and the information is transmitted to the control unit B1 as a signal. To perform printing, the control unit B1 controls the individual motors according to the instructions and the sensor information.

The above-described head mounting mechanism according to the exemplary embodiment is implemented in the image forming unit B14.

While described with reference to exemplary embodiments, it is to be understood that the disclosure is not limited to the disclosed exemplary embodiments. The scope of the following claims is to be accorded the broadest interpretation so as to encompass all modifications, equivalent structures, and functions.

This application claims priority from Japanese Patent Application No. 2011-179609 filed Aug. 19, 2011, which is hereby incorporated by reference herein in its entirety.

What is claimed is:

1. A movable carriage unit for mounting a head for discharging ink, the movable carriage unit comprising:

a carriage in which a mounting portion configured to mount the head is formed;

a fixing member movable to a fixing position for fixing the head to the mounting portion and to a releasing position for releasing the fixation of the head; and an operating member configured to move between a first position and a second position in relation to the carriage and provided with a guide portion for guiding the head to the mounting portion, wherein, when the operating member moves to the first position, the operating member moves the fixing member to the releasing position and the guide portion is placed to a position where the guide portion is able to guide the head to the mounting portion while supporting the head from underneath, and wherein, when the operating member moves from the first position to the second position, the operating member moves the fixing member from the release position to the fixing position.

2. The movable carriage unit according to claim 1, wherein the fixing member is configured to fix the head by pressing the head to contact a pressure reception portion formed on the head.

3. The movable carriage unit according to claim 1, further comprising a spring configured to press the fixing member to contact the pressure reception portion of the head when the fixing member is at the fixing position.

4. The movable carriage unit according to claim 1, wherein the head includes a protruding portion configured to be in contact with the guide portion.

5. The movable carriage unit according to claim 1, wherein the guide portion is a first guide portion and the carriage includes a second guide portion configured to guide the head to the mounting portion.

6. The movable carriage unit according to claim 1, wherein the head includes a conductor exposed portion and the carriage includes a connector configured to be electrically connect with the conductor exposed portion.

7. A recording apparatus comprising the movable carriage unit according to claim 1, wherein the movable carriage unit is configured to record an image on a sheet while moving.

8. A recording apparatus comprising:

a head for discharging ink;

a carriage in which a mounting portion configured to mount the head is formed;

a fixing member movable to a fixing position for fixing the head to the mounting portion and to a release position for releasing the fixation of the head; and an operating member configured to move between a first position and a second position in relation to the carriage and provided with a guide portion for guiding the head to the mounting portion, wherein, when the operating member moves to the first position, the operating member moves the fixing member to the release position and the guiding portion is placed to a position where the guide portion is able to guide the head to the mounting portion while supporting the head from the underneath, and wherein, when the operating member moves from the first position to the second position, the operating member moves the fixing member from the release position to the fixing position.

9. The recording apparatus according to claim 8, wherein the fixing member is configured to fix the head by pressing the head to contact a pressure reception portion formed on the head.

10. The recording apparatus according to claim 9, further comprising a spring configured to press the fixing member to contact the pressure reception portion of the head when the fixing member is at the fixing position.

11. The recording apparatus according to claim 8, wherein the head includes a protruding portion configured to be in contact with the guide portion.

12. The recording apparatus according to claim 8, wherein the guide portion is a first guide portion and the carriage includes a second guide portion configured to guide the head to the mounting portion.

13. The recording apparatus according to claim 8, wherein the head includes a conductor exposed portion and the carriage includes a connector configured to electrically connect with the conductor exposed portion.

14. The recording apparatus according to claim 8, further comprising a cartridge, wherein the head is provided on the cartridge.

* * * * *